United States Patent [19]

Wilson

[11] 4,104,926

[45] Aug. 8, 1978

[54] STARTER MOTORS

[76] Inventor: Ronald Wilson, 13 Chelmsley Lane, Marston Green, Birmingham, England

[21] Appl. No.: 712,809

[22] Filed: Aug. 9, 1976

[30] Foreign Application Priority Data

Aug. 21, 1975 [GB] United Kingdom ..... 34718/75

[51] Int. Cl.[2] ..... F02N 15/06

[52] U.S. Cl. ..... 74/6; 74/7 R

[58] Field of Search ..... 74/6, 7 R, 7 A

[56] References Cited

U.S. PATENT DOCUMENTS

| | | | |
|---|---|---|---|
| 3,020,771 | 2/1962 | Redick et al. | 74/7 A |
| 3,051,136 | 8/1962 | Muehlhausen | 74/7 R X |
| 3,399,575 | 9/1968 | Seilly et al. | 74/7 R |
| 3,399,576 | 9/1968 | Seilly et al. | 74/7 R |
| 3,955,427 | 5/1976 | Squires | 74/7 A |

FOREIGN PATENT DOCUMENTS 2,125,905 9/1972 France.

OTHER PUBLICATIONS

U.S. Machine Design, Mar. 1967, pp. 27–36.

*Primary Examiner*—Allan D. Herrmann
*Attorney, Agent, or Firm*—Holman & Stern

[57] ABSTRACT

A starter motor wherein a seal is provided between the casing and the pinion assembly. The pinion assembly carries a cylindrical component which does not rotate but which moves axially with the assembly. The seal is annular and is carried by the casing with its inner periphery engaging said component throughout the range of axial movement of the assembly.

2 Claims, 3 Drawing Figures

STARTER MOTORS

This invention relates to starter motors, for internal combustion engines, of the kind including a casing, a shaft rotatably mounted in the casing and supporting a pinion gear wheel assembly, the gear wheel assembly being rotatable with the shaft and movable axially relative thereto between a rest position and an operative position, and an electric motor for rotating said shaft.

A problem experienced with certain starter motors of the kind specified is ingress of dirt and moisture by way of a clearance between the casing and the pinion assembly and it is an object of the present invention to reduce this problem.

According to the invention, in a starter motor of the kind specified there is provided an annular seal secured to the casing, and encircling the pinion assembly, the inner periphery of said seal co-operating with the outer surface of a cylindrical component carried by the pinion assembly, said cylindrical component being held against rotation relative to the casing, but being movable axially with the pinion assembly, and said cylindrical component and said seal being so arranged that said seal remains in contact with said cylindrical component throughout the range of axial movement of the pinion assembly relative to the casing.

Conveniently a second annular seal is provided, said second seal being located between the pinion assembly and said cylindrical component, and said second seal being arranged to accommodate relative rotation between the pinion assembly and the cylindrical component.

Figure 1:
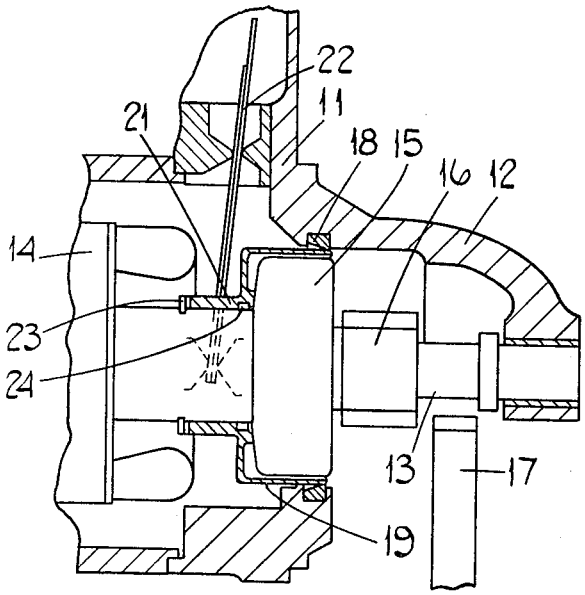
Figure 2:
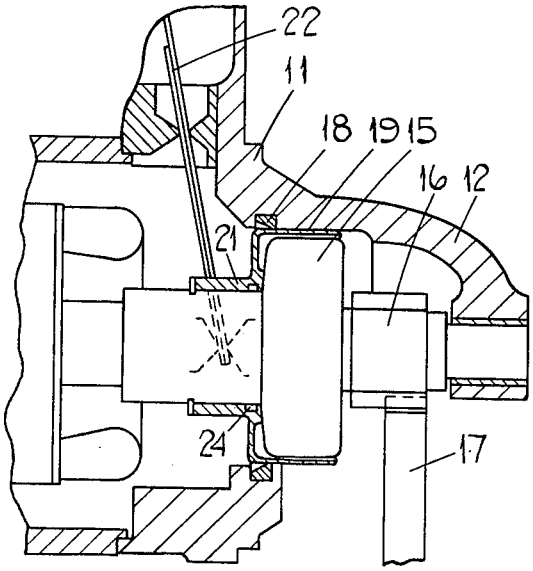
Figure 3:
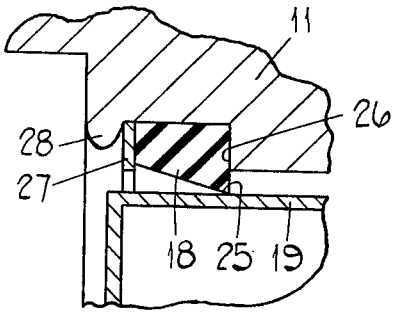

One example of the invention is illustrated in the accompanying drawings, wherein FIG. 1 is a diagrammatic representation of a starter motor with the pinion assembly thereof in a rest position, FIG. 2 is a view similar to FIG. 1 but showing the pinion assembly in an operative position, and FIG. 3 is an enlarged sectional view of a modification of the seal arrangement shown in FIGS. 1 and 2.

Referring first to FIGS. 1 and 2 of the drawings the starter motor includes a casing 11 extended at one end to define a bell-like housing part 12. Journalled for rotation in the casing by means of at least a pair of bearings one of which is provided in the part 12 is a rotor shaft 13. The rotor shaft 13 carries the rotor assembly 14 of an electric motor, the stator assembly of the motor being secured to the inner surface of the casing 11. When the electric motor is energised the shaft 13 rotates in its bearings relative to the housing 12. Supported by the shaft 13, and rotatable with the shaft 13 is a pinion assembly including a uni-directional roller clutch 15 and a pinion gear wheel 16. The outer race of the roller clutch 15 is integral with a sleeve encircling the shaft 13, and the inner race of the clutch 15 is integral with the pinion gear wheel 16 through which the shaft 13 extends. When the shaft 13 rotates the pinion gear wheel 16 rotates with the shaft by virtue of a driving connection between the sleeve of the clutch 15 and the shaft 13. The pinion gear wheel assembly is movable axially relative to the shaft 13 between a rest position shown in FIG. 1, and an operative position shown in FIG. 2 wherein the pinion gear wheel 16 meshes with the toothed wheel 17 of an engine to be started.

The arrangement so far described is conventional, and the driving connection between the pinion gear wheel assembly and the shaft 13 can be by way of axial, or helical splines. Where axial splines are chosen then there is no relative rotation between the shaft and the pinion assembly other than that occurring between the pinion gear wheel 16 and the shaft 13 when the roller clutch 15 slips. Where a helical spline connection is chosen then the relative axial movement is accompanied by relative rotational movement although it will be understood that the shaft 13 does not rotate freely relative to the pinion assembly and when the pinion assembly reaches its operative position then the pinion assembly rotates with the shaft.

In order to minimise ingress of dirt and moisture into the starter motor by way of the clearance between the periphery of the roller clutch 15 and the casing 11, 12 there is provided an annular seal 18 secured to the casing and encircling the pinion assembly coaxially therewith. The annular seal 18 is received, and retained in an annular groove in the casing and includes a lip projecting radially inwardly from the inner wall of the casing towards the outer periphery of the roller clutch 15.

Encircling the roller clutch assembly 15 and extending between the periphery of the roller clutch assembly 15 and the casing 11, 12 is a moulded synthetic resin sleeve 19 the outer cylindrical surface of the sleeve 19 is in sliding contact with the inner peripheral lip of the seal 18, and integral with the sleeve 19 is a sleeve 21 of reduced diameter which encircles the sleeve integral with the clutch outer race. The unit defined by the sleeves 19, 21 is held against rotation relative to the casing 11, 12 by a lever 22 pivotally mounted in the casing 11. The lever 22 is coupled at one end to the plunger of a solenoid, and coupled at its other end to the sleeve 21. Energisation of the solenoid causes retraction of the plunger, accompanied by pivoting movement of the lever 22. The pivoting movement of the lever 22 transmits the movement of the solenoid plunger to the sleeve 21 to push the pinion assembly together with the sleeves 19, 21 from its rest position towards its operative position.

At one end the sleeve 21 abuts the outer race of the clutch 15, and at its opposite end is in abutment with a circlip 23 engaged with the sleeve integral with the clutch outer race. Thus the sleeve 21 and therefore the sleeve 19 cannot move axially relative to the pinion assembly and by virtue of the lever 22 cannot rotate relative to the casing. Thus during axial movement of the pinion assembly the sleeve 19 moves with the pinion assembly, but during rotation of the pinion assembly the pinion assembly rotates relative to the sleeve 19.

It will be understood therefore that the sleeve 19 is in axial sliding contact with the seal 18 and since relative rotation does not have to be accommodated an effective seal is achieved between the casing and the sleeve. The sleeve 19 is of an axial length, in relation to the position of the seal 18, and the travel of the pinion assembly, such that it remains in contact with the lip of the seal 18 throughout the range of movement of the pinion assembly.

There is a relative small clearance between the inner surface of the sleeve 19 and the outer race of the clutch 15. Furthermore, the sleeve 21 which is integral with the sleeve 19 is a similarly close fit on its supporting sleeve, and thus ingress of dirt and moisture into the casing 11 by way of the clearance between the sleeves 19, 21 and the pinion assembly is virtually non-existent. In severely wet conditions however ingress of moisture might occur, and so where the starter motor is intended foruse in such conditions an annular sealing ring 24 can be provided between the sleeve 21 and the sleeve integral with the clutch race 15. The seal 24 is housed in an annular channel in the inner surface of the sleeve 21 and is arranged to accommodate rotation of the pinion assembly relative to the sleeve 21. The seal 24 does not of course need to accommodate relative axial movement.

The seal arrangement shown in FIG. 3 uses an annular seal 18 substantially as described above, the lip 25 of which is in axial sliding contact with the sleeve 19. However, rather than being received in a groove in the casing 11 the seal 18 is received in an annular channel defined between a shoulder 26 of the casing 11 and a separate washer 27 parallel to the shoulder 26. The washer 27 is retained in position relative to the shoulder 26 in one direction by engagement with the seal 18, and in the other direction by engagement with a bead 28 raised by the casing 11 during manufacture of the starter motor, and after positioning of the seal 18 and the washer 27. It is to be understood that the annular bead 28 could be replaced by a series of localized deformed regions of the casing 11 which would, in a similar manner, retain the washer 27 in position.

I claim:

1. A starter motor, for an internal combustion engine, including a casing, a shaft rotatably mounted in the casing and supporting a pinion gear wheel assembly, the gear wheel assembly being rotatable with the shaft and being movable axially relative to the shaft between a rest position and an operative position, an electric motor for rotating said shaft, an annular seal secured to the casing, said seal encircling the pinion assembly a cylindrical component carried by the pinion assembly, said cylindrical component being held against rotation relative to the casing, but being movable axially with the pinion assembly, and, the inner periphery of said seal co-operating with the outer surface of said cylindrical component, said cylindrical component and said seal being so arranged that said seal remains in contact with said cylindrical component throughout the range of axial movement of the pinion assembly relative to the casing.

2. A starter motor as claimed in claim 1 wherein a second annular seal is provided, said second seal being located between the pinion assembly and said cylindrical component, and said second seal being arranged to accommodate relative rotation between the pinion assembly and the cylindrical component.

* * * * *